US008539904B2

(12) United States Patent
Lintula et al.

(10) Patent No.: US 8,539,904 B2
(45) Date of Patent: Sep. 24, 2013

(54) ROD-BED ASSEMBLY

(75) Inventors: Timo S. Lintula, Keuruu (FI); Ari-Pekka Kautto, Jyskä (FI); Sami Kuparinen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 31 days.

(21) Appl. No.: 13/376,784

(22) PCT Filed: May 17, 2010

(86) PCT No.: PCT/EP2010/056718

§ 371 (c)(1),
(2), (4) Date: Dec. 7, 2011

(87) PCT Pub. No.: WO2010/142513

PCT Pub. Date: Dec. 16, 2010

(65) Prior Publication Data

US 2012/0073496 A1 Mar. 29, 2012

(30) Foreign Application Priority Data

Jun. 8, 2009 (DE) ..... 10 2009 026 823

(51) Int. Cl.
*B05C 1/08* (2006.01)

(52) U.S. Cl.
USPC ..... 118/262; 118/110; 118/123; 118/126; 118/413

(58) Field of Classification Search
USPC ..... 118/123, 126, 413, 414, 110, 261, 118/262; 101/120, 363; 162/261, 281; 15/256.5, 256.51, 256.52; 427/428.14, 359
See application file for complete search history.

(56) References Cited

U.S. PATENT DOCUMENTS

| | | | | |
|---|---|---|---|---|
| 5,934,638 | A * | 8/1999 | Provot | 248/346.02 |
| 2007/0144434 | A1 * | 6/2007 | Kautto et al. | 118/506 |
| 2010/0089313 | A1 * | 4/2010 | Karusalmi et al. | 118/244 |

FOREIGN PATENT DOCUMENTS

| | | | |
|---|---|---|---|
| DE | 3236991 | A1 | 4/1984 |
| DE | 19602483 | C1 | 6/1997 |
| DE | 10045515 | A1 | 4/2002 |
| DE | 20218781 | U1 | 4/2003 |
| EP | 1485209 | A1 | 12/2004 |
| WO | 0063494 | A1 | 10/2000 |
| WO | 03078077 | A1 | 9/2003 |
| WO | 2005061798 | A1 | 7/2005 |
| WO | 2007063183 | A1 | 6/2007 |
| WO | 2010142513 | A1 | 12/2010 |

OTHER PUBLICATIONS

International Search Report for PCT/EP2010/056718.
Written Opinion of the International Searching Authority for PCT/EP2010/056718.

* cited by examiner

*Primary Examiner* — Yewebdar Tadesse
(74) *Attorney, Agent, or Firm* — Stiennon & Stiennon

(57) ABSTRACT

A rod bed assembly (1, 11, 111) has a holder (2) made of a composite material according to a continuous primary molding method, a rod bed (3) made of a polymer according to a continuous primary molding method, and a doctor rod (4) rotatably supported in a bearing recess (34) on the front side of the rod bed. The holder (2) is formed such that the rod bed (3) and the doctor rod (4) are insertable into and removable from a socket provided in the holder in the radial direction of the doctor rod (4). The rod bed (3) has closed cavities for saving material.

14 Claims, 3 Drawing Sheets

ROD-BED ASSEMBLY

CROSS REFERENCES TO RELATED APPLICATIONS

This application is a U.S. national stage application of International App. No. PCT/EP2010/056718, filed May 17, 2010, the disclosure of which is incorporated by reference herein, and claims priority on German App. No. 10 2009 026 823.5 filed Jun. 8, 2009.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention concerns a rod-bed assembly and, to be more precise, a rod-bed assembly for a device for coating a material web, particularly a paper or cardboard web.

When coating paper or cardboard in a paper machine, it is necessary to apply a liquid coating medium, such as a coating material, onto the paper or cardboard web running through the paper machine. This is usually effected by an excessive application of the coating medium and by a subsequent reduction or dosing of the coating medium to the desired quantity. The dosing of the coating medium is usually carried out by a dosing apparatus, such as a rod-bed assembly having a doctor rod as dosing element for scraping off the excessive material quantity.

Such a rod-bed assembly is known from EP 1 485 209 A1 or WO 03/078077 A1 where a metal doctor rod is insertable into a rod bed made of an elastomer. The rod bed is inserted into a holding groove of a holder also made of an elastomer. In order to ensure a safe hold of the doctor rod, the holder is formed as a kind of bracket in combination with a pressure hose which continuously presses against a bracket leg during the operation of the rod-bed assembly for fixing the doctor rod. This serves to press the groove walls of the holder groove against each other in a direction towards the rod bed, so that the inserted doctor rod is rotatably held over the rod bed. Additionally, a further pressure hose is provided on the rear side, i.e. on a side of the holder facing away from the holder groove, enabling a flexible movement of the holder so as to adjust a position of the doctor rod with respect to the paper web to be coated.

It is a problem of this state of the art that the pressure hose pressing against the one bracket leg has to be under constant pressure during the operation of the rod-bed assembly. Moreover, a further pressure hose has to be provided for effecting the adjustment of the doctor rod.

A further rod-bed assembly is known from WO 2007/063183 A1, which basically shows a similar construction as the above-described rod-bed assembly. In this case, however, no pressure hose for securing the doctor rod is used. Instead, the rod bed has been given a special outer shape with a tapering cross-section, by which a securing of the doctor rod in the flexible rod bed is achieved by pressing the doctor rod into the rod bed inserted in the holder. This means that the rod bed has a self-securing function due to the pressed-in doctor rod in the holder; said function can be further reinforced in operation by the doctor rod being pressed on the paper web.

It is a problem of the aforementioned prior art that the rod bed of the rod-bed assembly is a wearing part that has to be replaced regularly. This, however, is made difficult by the doctor rod being pressed into the rod bed for being secured in the holder, thereby "wedging" the rod bed in the holder. It is very complicated and time-consuming to remove the doctor rod from the rod bed, and the rod bed from the holding groove. Additionally, the rod bed is carved out of solid matter, wherein machining traces may occur in the machined surfaces, among others in the sliding bearing of the doctor rod, which negatively affect the sliding properties of the doctor rod. Besides, a lubricant for lubricating the doctor rod can pass through the machining traces and mix with the coating medium, thereby impairing the quality of the same. It is also conceivable that the coating material settles in the machining traces and dries there, which may disturb a continuous coating medium film on the doctor rod, or even increase a wear of the doctor rod.

As a further example for a known rod-bed assembly, DE 100 45 515 A1 shows a doctor rod-dosing-assembly for paper or cardboard web coating devices, which comprises a holder, a doctor bed inserted into the holder and made according to a continuous primary molding method, and a doctor rod rotatably supported in the doctor bed.

SUMMARY OF THE INVENTION

To solve the aforementioned problems of the prior art, it is an object of the invention to provide a cheap and lightweight rod-bed assembly whose rod bed or insert is easily replaceable. The rod-bed assembly according to the invention comprises a holder or frame, a rod bed or insert, and a doctor rod which is exposedly rotatably supported in a bearing recess provided on the front side of the rod bed. The holder is made from a composite material according to a continuous primary molding method, e.g. a pultrusion method, such that the rod bed and the doctor rod are insertable into and removable from a recess provided in the holder from the front, i.e. in the radial direction of the doctor rod, wherein the rod bed comprises closed cavities for material savings.

The composite material of the holder is preferably a glass fiber composite material, in which glass fibers are embedded in a matrix made of epoxy resin or vinyl ester. Alternatively, the composite material may also be a carbon fiber composite material or a composite material made of a mixture of glass fibers and carbon fibers. The composite material may also be a glass-ball reinforced plastic.

Wherein a holder having a rod bed inserted is described, a one-piece holder is conceivable, i.e. a holder having an integrated rod bed, for which a glass-ball reinforced plastic is used, as well.

The rod bed is made of a polymer according to a continuous primary molding method, e.g. an extrusion process. The polymer of the rod bed is preferably an HD polyethylene, but may also be any other polymer capable of being extruded. Alternatively, the rod bed may also be produced from an elastomer, such as rubber or polyurethane. Polyurethane may be mixed with a lubricant, such as aluminum oxide, zeolithe, calcium carbonate, barium sulfate or glass balls. Furthermore, polyurethane can be mixed with nano particles which are soft or hard, and which can be provided as separate filling elements or linked with the polyurethane structure.

Furthermore preferably, a part of the holder facing the upper side of the rod bed, a part of the holder facing the rear side of the rod bed, and a part of the holder facing the lower side of the rod bed form a socket basically in a C-shape, with the doctor rod being held in the C-shaped opening of the socket. The part of the holder facing the upper side of the rod bed is basically perpendicular to the part of the holder facing the rear side of the rod bed, which in turn is basically perpendicular to the part of the holder facing the lower side of the rod bed.

Furthermore, the holder may comprise a supporting arm projecting basically perpendicular from the side of the holder facing away from the C-shaped opening to the rear side of the socket and communicating with an adjusting hose for adjusting the radial position of the doctor rod. One side of the adjusting hose is fixed so as to be stationary, e.g. on a paper machine frame, to which also the holder may be fixed. Furthermore, the adjusting hose is preferably a pressure hose with a pressure increase in the pressure hose expanding the hose, so that said hose presses against the supporting arm, thereby pressing the holder in the direction of the paper web to be coated.

Alternatively, the holder may be composed of a holder main body and a tilting lever rotatably supported on the holder main body. A front part of the tilting lever facing the upper side of the rod bed, a part of the holder facing the rear side of the rod bed, and a part of the holder facing the lower side of the rod bed form a socket in the holder basically in a C-shape, the doctor rod being held in the C-shaped opening. Preferably, in the installed state of the rod bed, the front part of the tilting lever abuts on the upper side of the rod bed and a rear part of the tilting lever communicates with a hose, wherein an expansion and/or a contraction of the hose causes a tilting movement of the tilting lever. Preferably, the hose is a pressure hose, as it has already been described previously, and is fastened to a supporting arm of the holder, projecting from a side of the holder facing away from the rod bed. Alternatively, the hose may also be subjected to a negative pressure, whereby the contraction of the hose can be caused.

Furthermore preferably, the supporting arm communicates with an adjusting hose for adjusting the radial position of the doctor rod, as has already been described above.

In a further preferable embodiment of the rod-bed assembly, the socket is defined by at least one projection and the rod bed comprises at least one recess that corresponds to the projection and engages with the projection when the rod bed is inserted into the C-shaped opening. Furthermore preferably, the socket may comprise a projection at an upper and a lower side, respectively, said projection corresponding to a respective recess at the upper and lower side of the rod bed and being adapted to engage therewith.

The bearing recess at the front side of the rod bed can comprise a channel which is open towards the doctor rod, said channel being adapted to serve as a lubricant channel into which a lubricant for increasing the operability of the doctor rod is inserted.

Moreover, the rod bed may have a shape with a tapering cross-section, where the distance between the upper side and the lower side of the rod bed decreases from the front side to the rear side of the rod bed. Due to this, the rod bed is guided in the holder when the doctor rod is inserted into the bearing recess of the rod bed. Accordingly, the rod bed has a self-adjusting function in the recess of the holder. Besides, due to the tapering shape, a possible pressing of the doctor rod into the rod bed can be balanced without the upper and the lower side of the rod bed already abutting on the inner wall of the socket. As soon as the upper side and/or the lower side abut(s) on the inner wall of the socket, a further application of a pressure force to the doctor rod, i.e. the further pressing-in of the doctor rod into the rod bed or alternatively a further pressing by the tilting lever, causes the rod bed to apply forces to the doctor rod, whereby the rotational properties of the doctor rod can be controlled.

There may further be a groove at the rear side of the rod bed; this groove also serves as balancing means for balancing a pushing-in of the doctor rod into the rod bed. It is possible by the self-adjusting function which results from the special form of the rod bed to use quite large manufacturing tolerances for the manufacture of the rod bed and the holder, whereby the manufacture of the rod-bed assembly is simplified.

Depending on the diameter of the doctor rod, differently large rod-bed assembly elements can be used. For instance, for doctor rods having a diameter of 20 to 25 mm, a larger rod bed and, thus, a larger holder are required. It would, however, be conceivable, as well, to use a large holder for every doctor rod irrespective of the diameter, with the size and the characteristics of the rod bed having to be adapted accordingly.

Since the holder is extruded from a comparatively rigid material, namely a composite material, it is possible to use a softer and cheaper polymer for the rod bed and to manufacture this in an extrusion process. In this way, a better surface quality of the rod bed compared to the prior art can be achieved, whereby the rotational properties of the doctor rod in the rod bed are improved. Furthermore, a softer rod bed can be replaced more easily, i.e. it is easier to remove the rod bed from the holder and to insert a new comparable rod bed into the same. Also, in making the rod bed softer and, thereby, more flexible, the rod bed can be coiled, i.e. the rod bed can be wrapped up or wound in coils, such that logistics, shipping and warehousing of rod beds can be improved and respective costs can be saved significantly.

In order to save material in the manufacture of the rod bed and in order to design a more flexible rod bed on demand, closed cavities are provided in the rod bed; these are being provided when the rod bed is extruded. During the pultrusion of the holder, similar material-saving hollow spaces can also be provided in places, while a rigidity and, thus, a stability of the holder should be maintained.

BRIEF DESCRIPTION OF THE DRAWINGS

In the following, the invention shall be explained in detail by means of some preferred embodiments with reference being made to the figures.

DESCRIPTION OF THE PREFERRED EMBODIMENTS

Figure 1:
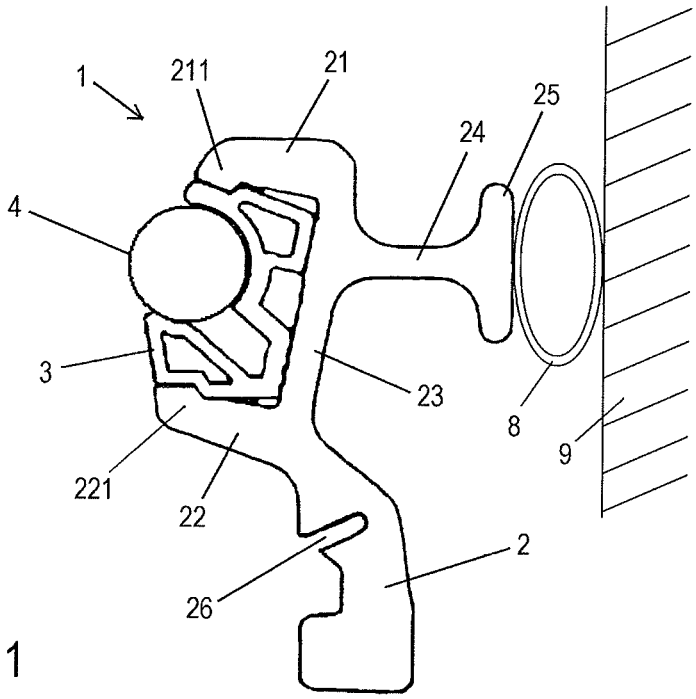
FIG. 1 shows a first preferred embodiment of the rod-bed assembly according to the invention in its assembled state.
Figure 2:
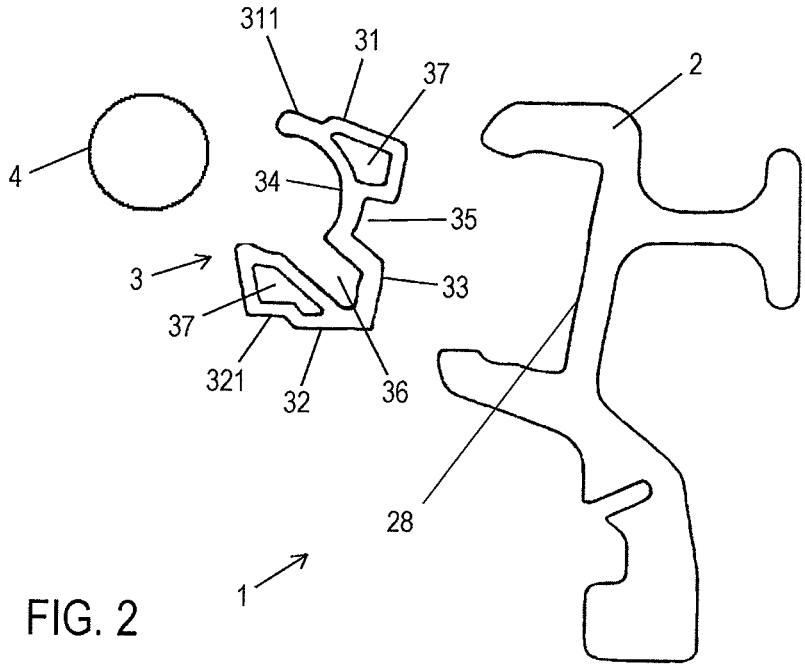
FIG. 2 shows the first preferred embodiment of the rod-bed assembly shown in FIG. 1 in an exploded view.

FIGS. 1 and 2 show a first preferred embodiment of the rod-bed assembly according to the invention.

A frame or holder 2 of the rod-bed assembly 1 is manufactured of a composite material in a pultrusion method, and an insert or rod bed 3 of the rod-bed assembly 1 is manufactured of an HD polyethylene in an extrusion process.

In the rod-bed assembly 1 in its assembled state, a rod bed 3 is inserted into a socket 28 provided in a holder 2 as indicated in FIG. 2, and a doctor rod 4 is inserted into a bearing recess 34 of the rod bed 3. The socket 28 of the holder 2 basically has a C-shape, which, as shown in FIG. 1, is composed of an upper holder part 21, a lower holder part 22, and a rear holder part 23, which are disposed basically perpendicular to each other.

The rear holder part 23 is further provided with a supporting arm 24 at whose rear free end a pressing section 25, which is arranged basically perpendicular to the supporting arm 24, is provided, and abuts on an adjusting hose 8 in the operation of the rod-bed assembly 1. The adjusting hose 8 is fastened to a machine frame part 9, on which also the holder 2 can be fastened, and serves to adjust the position of the doctor rod 4 with respect to the paper or cardboard web to be coated.

The front end of the upper holder part 21 is provided with a projection 211 which extends to the inner side of the socket 28. Similarly, the lower holder part 22 is provided with a projection 221 which extends to the inner side of the socket 28. The holder is further provided with a recess 26 in which, in the operation of the rod-bed assembly 1, a seal (not shown) is inserted for preventing a leakage of the coating medium from the rod-bed assembly. Such a seal is, for instance, described in the utility model document DE 202 18 781 U1.

As shown in FIG. 2, an upper side 31 of the rod bed 3 is provided with a recess 311 which corresponds to the projection 211 of the holder 2. Similarly, the lower side 32 of the rod bed 3 is provided with a recess 321, which corresponds to the projection 221 of the holder 2. When the rod bed 3 is inserted into the socket 28, the projection 211 becomes engaged with the recess 311, and the projection 221 becomes engaged with the recess 321.

The rear side 33 of the rod bed 3 abuts planar in surface contact on the inner side of the rear holder part 23. Since the rod bed 3 furthermore has a shape with a cross-section tapering rearwards, compared thereto, neither the upper side 31 of the rod bed 3 abuts, face to face, on the inner side of the upper holder part 21, nor the lower side 32 of the rod bed 3 on the inner side of the lower holder part 22.

When the rod-bed assembly 1 is operated, the doctor rod 4 is pressed on the paper or cardboard web to be coated to apply a force thereon in the radial direction of the doctor rod 4, whereby the doctor rod 4 is pressed in the direction of the bearing recess 34 of the rod bed 3. This pressing of the doctor rod 4 into the bearing recess 34 is balanced by the tapering shape in that the upper side 31 and the lower side 32 of the rod bed 3 approach the respective inner side of the socket 28 and, provided the pressing force is sufficiently high, abut thereon over their entire surface, respectively. Due to this "balancing movement" of the rod bed 3, the rod bed 3 can be secured in the socket 28 in a desired position, i.e. a self-adjusting function of the rod-bed assembly 1 is reached. Furthermore, any undesired pressing force acting on the doctor rod 4 through the paper or cardboard web to be coated (not shown) can be balanced. If the doctor rod 4 is further pressed on the paper or cardboard web beyond the balancing function, it can be achieved that the rod bed 3 accordingly transmits the excessive pressing force to the doctor rod 4 in the radial direction, whereby the rotational properties of the doctor rod 4 can be affected. For instance, this may cause a deceleration or a complete standstill of the rotational movement of the doctor rod 4.

The tapering shape of the rod bed 3 is further advantageous in that the rod bed 3 consisting of a soft polymer can quite easily be removed from the holder 2 after the doctor rod 4 has been removed from the rod bed 3. This makes it much easier to replace the rod bed 3, which constitutes a wearing part in the rod-bed assembly.

Moreover, the rod bed 3 comprises a groove 35 in the rear side 33 of the rod bed 3; this groove serves to further balance the pressing force acting on the doctor rod 4 by deformation of the rod bed 3. Moreover, the groove 35 also contributes to further facilitating a replacement of the rod bed 3 by improving a resetting movement of the rod bed 3 after the doctor rod 4 has been removed.

The doctor rod 4, which, in operation, turns in the recess 34 of the rod bed 3, is lubricated by means of a channel 36, which is open towards the doctor rod 4 and into which a lubricant can be introduced when the rod-bed assembly 1 is in operation. Moreover, wear particles which may occur when the doctor rod 4 turns in the bearing recess 34 can be discharged by the channel 36 being rinsed with the lubricant.

Further recesses 37 in the rod bed 3 in the form of closed cavities or hollow spaces have been produced during the extrusion of the rod bed 3 in the same in order to save material during manufacture.

Figure 3:
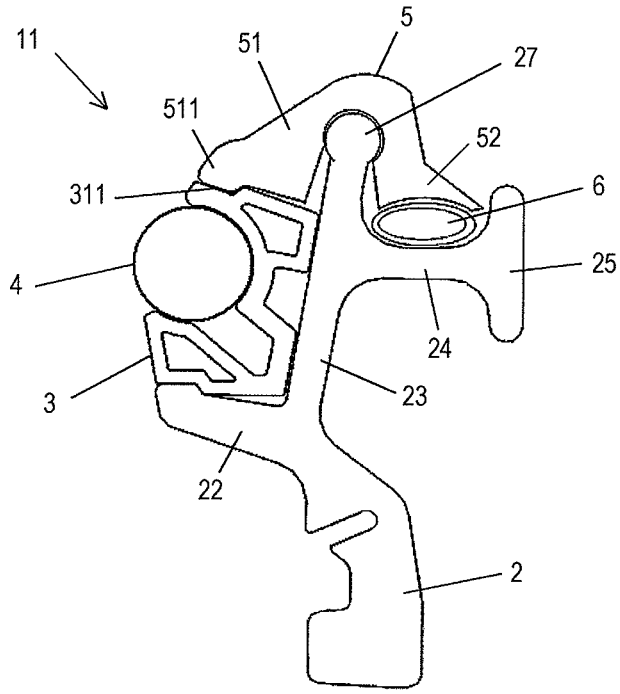
FIG. 3 shows a second preferred embodiment of the rod-bed assembly according to the invention in its assembled state.

A second embodiment of the rod-bed assembly according to the invention is shown in FIG. 3. The description of components and elements which have already been described in the above first embodiment also applies in this embodiment, and has been omitted below for reasons of clarity.

In the rod-bed assembly 11 shown in FIG. 3, the upper end of the holder 2 shows, instead of an upper holder part, a joint head 27 to which a tilting lever 5 is rotatably fastened. A front end 51 of the tilting lever 5 provides an inner side of the socket 28 provided in the holder 2, a projection 511 fitting the recess 311 of the rod bed 3 being provided on the front end 51 of the tilting lever 5. A rear end 52 of the tilting lever 5 communicates with a pressure hose 6, and an expansion of the pressure hose 6 causes a movement of the tilting lever 5. This makes the front end 51 of the tilting lever 5 move in the direction of the rod bed 3, so that the projection 511 engages with the recess 311. When, on the other hand, pressure is removed from the pressure hose 6, the force at which the projection 511 engages with the recess 311 decreases and the doctor rod 4 can easily be removed from the rod bed 3. Subsequently, the rod bed 3 can quite easily be replaced.

In this embodiment, a high pressure in the hose 6 serves to tilt the tilting lever 5 further ahead to press it on the rod bed 3. In this way, in turn, the rotational properties of the doctor rod 4 can be influenced. This may e.g. decelerate the rotational movement of the doctor rod 4, or take it to a complete standstill.

Figure 4:
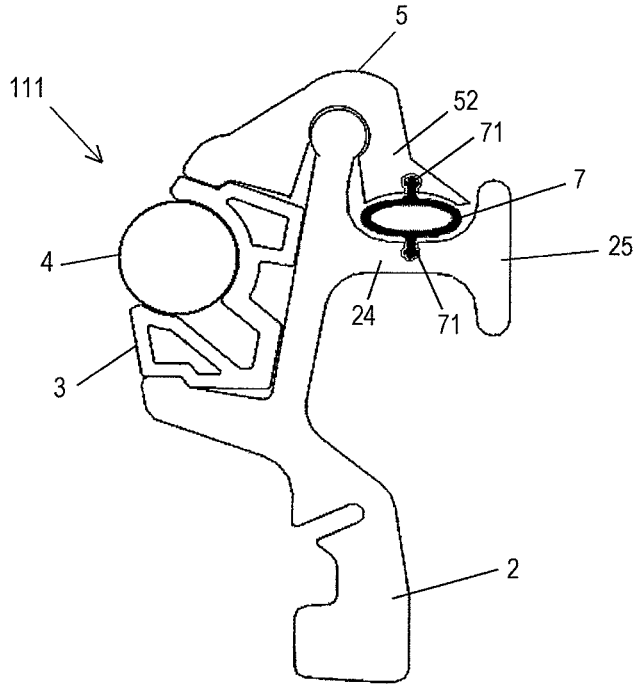
FIG. 4 shows a third preferred embodiment of the rod-bed assembly according to the invention in its assembled state.

A third embodiment of the rod-bed assembly according to the invention is shown in FIG. 4. The description of components and elements which have already been described in the above embodiments also applies in this embodiment, and has been omitted below for reasons of clarity.

This embodiment does not show a pressure hose 6, but a pressure and tension hose 7 which is connected to the tilting lever 5 and the supporting arm 24 through connecting elements 71. This makes it possible to cause a forward or rearward tilting movement of the tilting lever 5 depending on the application of a pressure or a negative pressure. A removal and an insertion of the doctor rod 4 and the rod bed 3 are considerably facilitated thereby. Moreover, an excessive forward tilting movement of the tilting lever 5 serves to apply a force on the rod bed 3, whereby the rod bed 3 applies forces in the radial direction of the doctor rod 4 on the same. This serves to influence the rotational properties of the doctor rod 4. For instance, a rotation of the doctor rod 4 can be decelerated or brought to a complete standstill.

The invention claimed is:

1. A rod bed assembly comprising a holder made of a composite material according to a continuous primary pultrusion molding method, a rod bed made of a polymer according to a continuous primary extrusion molding method, and a doctor rod rotatably supported in a bearing recess on a front side of the rod bed;

wherein the holder is formed such that the rod bed and the doctor rod are insertable into and removable from a socket provided in the holder in the radial direction of the rod, and the rod bed comprises closed cavities for saving material.

2. The rod bed assembly of claim 1 wherein a part of the holder facing an upper side of the rod bed, a part of the holder facing a rear side of the rod bed, and a part of the holder facing a lower side of the rod bed define a C-shaped opening of the socket and the doctor rod is held in the C-shaped opening of the socket.

3. The rod bed assembly of claim 2 wherein the holder further comprises a supporting arm projecting from the side of the holder which is opposite to the C-shaped opening and communicates with an adjusting hose for adjusting the radial position of the doctor rod.

4. The rod bed assembly of claim 2 wherein the distance between the upper side and the lower side of the rod bed decreases from the front side to the rear side of the rod bed.

5. The rod bed assembly of claim 1 wherein the holder is comprised of a holder main body and a tilting lever rotatably supported on the holder main body and wherein a front part of the tilting lever facing an upper side of the rod bed, a part of the holder facing a rear side of the rod bed, and a part of the holder facing a lower side of the rod bed form the socket basically in a C-shape and the doctor rod is held in the C-shaped opening of the socket.

6. The rod bed assembly of claim 5 wherein the front part of the tilting lever abuts on the upper side of the rod bed in the installed state of the rod bed and a rear part of the tilting lever communicates with a hose connected to a supporting arm of the holder, said supporting arm projecting on a side of the holder facing away from the rod bed, wherein an expansion or a contraction of the hose causes a tilting movement of the tilting lever.

7. The rod bed assembly of claim 6 wherein a free end of the supporting arm communicates with an adjusting tube for adjusting the radial position of the doctor rod.

8. The rod bed assembly of claim 6 wherein the hose is connected to the rear part of the tilting lever and the supporting arm of the holder.

9. The rod bed assembly of claim 1 wherein the socket is limited by at least one projection and the rod bed comprises at least one corresponding recess which engages with the projection when the rod bed is inserted into the socket.

10. The rod bed assembly of claim 1 wherein the rod bed consists of HD polyethylene.

11. The rod bed assembly of claim 1 wherein the holder consists of a glass fiber composite material.

12. The rod bed assembly of claim 1 wherein the bearing recess at the front side of the rod bed comprises a channel which is open towards the doctor rod.

13. The rod bed assembly of claim 1 wherein a groove is provided on a rear side of the rod bed.

14. The rod bed assembly of claim 1 wherein the holder is rigid.

* * * * *